US011920503B2

(12) United States Patent
Takeda

(10) Patent No.: US 11,920,503 B2
(45) Date of Patent: Mar. 5, 2024

(54) VEHICLE ENGINE CONTROL DEVICE

(71) Applicant: SUBARU CORPORATION, Tokyo (JP)

(72) Inventor: Shuta Takeda, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 18/114,516

(22) Filed: Feb. 27, 2023

(65) Prior Publication Data

US 2023/0296043 A1 Sep. 21, 2023

(30) Foreign Application Priority Data

Mar. 15, 2022 (JP) ..... 2022-040627

(51) Int. Cl.
*F01N 11/00* (2006.01)

(52) U.S. Cl.
CPC ..... *F01N 11/007* (2013.01); *F01N 2550/02* (2013.01); *F01N 2560/025* (2013.01)

(58) Field of Classification Search
CPC ..... F01N 11/007; F01N 2550/02; F01N 2560/025
See application file for complete search history.

(56) References Cited

U.S. PATENT DOCUMENTS 6,453,662 B1 * 9/2002 Lewis ..... F01N 13/0097 60/276
7,198,952 B2 * 4/2007 Uchida ..... F01N 11/007 60/276
7,653,478 B2 * 1/2010 Park ..... B60W 10/08 903/905
2004/0060535 A1 * 4/2004 Osawa ..... B60W 10/06 123/481
2005/0115227 A1 * 6/2005 Surnilla ..... F02D 41/1408 60/286
2009/0025371 A1 * 1/2009 Hermansson ..... F01N 3/2033 290/1 A
2013/0226439 A1 * 8/2013 Hashemi ..... F02D 41/0295 701/112

FOREIGN PATENT DOCUMENTS

JP 2007-309113 A 11/2007

* cited by examiner

*Primary Examiner* — Matthew T Largi
(74) *Attorney, Agent, or Firm* — TROUTMAN PEPPER HAMILTON SANDERS LLP

(57) ABSTRACT

A vehicle includes an engine, a catalyst, an oxygen concentration detector, and a control device. The catalyst is configured to clean gas emitted from the engine. The oxygen concentration detector is configured to measure oxygen concentration in the catalyst. The control device includes at least one processor and at least one memory coupled to the at least one processor. The at least one processor is configured to perform processing including determining, based on condition of the engine and the oxygen concentration measured by the oxygen concentration detector, whether to prohibit the engine from being stopped.

3 Claims, 4 Drawing Sheets

VEHICLE ENGINE CONTROL DEVICE

CROSS-REFERENCE TO RELATED APPLICATION

The present application claims priority from Japanese Patent Application No. 2022-040627 filed on Mar. 15, 2022, the entire contents of which are hereby incorporated by reference.

FIELD OF THE INVENTION

The disclosure relates to a vehicle.

BACKGROUND

A hybrid automobile disclosed in Japanese Unexamined Patent Application Publication 2007-309113 controls an engine on the basis of the temperature of a catalyst. The engine of the hybrid automobile is stopped when a predetermined condition for stopping the engine is satisfied in a state in which the temperature of the catalyst is lower than or equal to a threshold value. The engine keeps running when the predetermined condition for stopping the engine is satisfied in a state in which the temperature of the catalyst is higher than the threshold value.

SUMMARY

An aspect of the disclosure provides a vehicle including an engine, a catalyst, an oxygen concentration detector, and a control device. The catalyst is configured to clean gas emitted from the engine. The oxygen concentration detector is configured to measure oxygen concentration in the catalyst. The control device includes at least one processor and at least one memory coupled to the at least one processor. The at least one processor is configured to perform processing including determining, based on condition of the engine and the oxygen concentration measured by the oxygen concentration detector, whether to prohibit the engine from being stopped.

BRIEF DESCRIPTION OF THE DRAWINGS

The accompanying drawings are included to provide a further understanding of the disclosure and are incorporated in and constitute a part of this specification. The drawings illustrate an embodiment and, together with the specification, serve to describe the principles of the disclosure.

DETAILED DESCRIPTION

In some cases, a hybrid automobile drives while being powered by its motor with its engine being stopped, and a driver who drives the hybrid automobile in such a situation depresses and eases off the accelerator pedal at short intervals. When the driver depresses the accelerator pedal in a state in which the engine is stopped, the engine is restarted. When the driver eases off the accelerator pedal in a state in which the engine is running, the engine is stopped. The automobile under certain circumstances goes back and forth between these states at frequent intervals.

When the engine is stopped, oxygen is discharged through the exhaust port without undergoing combustion in the cylinder and flows to the catalyst, in which case the oxygen concentration in the catalyst increases. When the engine is stopped shortly after being started, the oxygen concentration in the catalyst increases before decreasing to a sufficient degree. Starting and stopping the engine at frequent intervals therefore cause repeated increase in the oxygen concentration in the catalyst. As a result, the oxygen concentration in the catalyst reaches a high level. When the oxygen concentration in the catalyst exceeds the level at which the catalyst can remove NOx, the catalyst is unable to remove NOx adequately.

It is desirable to provide a vehicle that enables adequate functioning of the catalyst.

In the following, an embodiment of the disclosure is described in detail with reference to the accompanying drawings. Note that the following description is directed to an illustrative example of the disclosure and not to be construed as limiting to the disclosure. Factors including, without limitation, numerical values, shapes, materials, components, positions of the components, and how the components are coupled to each other are illustrative only and not to be construed as limiting to the disclosure. Further, elements in the following example embodiment which are not recited in a most-generic independent claim of the disclosure are optional and may be provided on an as-needed basis. The drawings are schematic and are not intended to be drawn to scale. Throughout the present specification and the drawings, elements having substantially the same function and configuration are denoted with the same numerals to avoid any redundant description.

Figure 1:
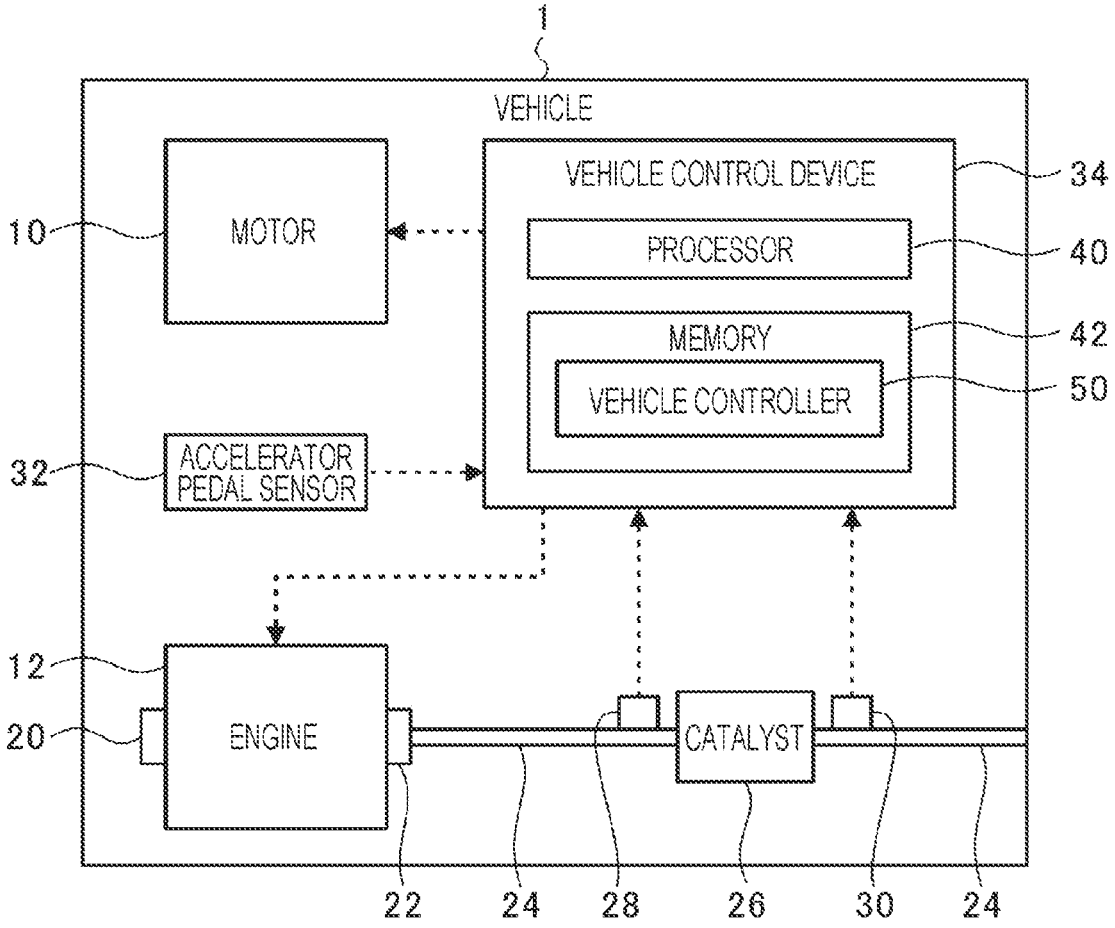
FIG. 1 is a block diagram illustrating the configuration of a vehicle according to an embodiment of the disclosure.

FIG. 1 is a block diagram illustrating the configuration of a vehicle 1 according to an embodiment of the disclosure. The vehicle 1 is a hybrid automobile and includes a motor 10 and an engine 12, which power the vehicle 1.

The motor 10 includes a rotor. The motor 10 is electrically coupled to a battery (not illustrated) with an inverter (not illustrated) therebetween. The rotor of the motor 10 rotates under electric power supplied by the battery. The driving force generated by rotation of the rotor of the motor 10 can be transmitted to axles and wheels of the vehicle 1.

The engine 12 includes an intake port 20 and an exhaust port 22. The engine 12 also includes a cylinder (not illustrated) and a piston (not illustrated) disposed in the cylinder.

When the intake port 20 is opened, air enters the cylinder through the intake port 20. Fuel is injected into the cylinder. The piston slides up and down in the cylinder due to combustion of an air-fuel mixture in the cylinder. The driving force generated by the sliding motion of the piston of the engine 12 can be transmitted to the axles and wheels of the vehicle 1 by way of a crankshaft.

The vehicle 1 includes, in addition to the motor 10 and the engine 12, an exhaust pipe 24, a catalyst 26, an A/F sensor 28, an $O_2$ sensor 30, an accelerator pedal sensor 32, and a vehicle control device 34.

The exhaust pipe 24 is coupled to the exhaust port 22. When the exhaust port 22 is opened, the gas in the cylinder is vented into the exhaust pipe 24 through the exhaust port 22. The exhaust pipe 24 is an exhaust passage through which gas emitted from the engine 12 flows.

The catalyst 26 is disposed between two ends of the exhaust pipe 24. The catalyst 26 cleans gas emitted from the engine 12. For example, the catalyst 26 is a three-way catalyst or a lean NOx trap (LNT). The three-way catalyst may contain platinum (Pt), palladium (Pd), and rhodium (Rh). Such a three-way catalyst removes hydrocarbons (HC), carbon monoxide (CO), and nitrogen oxides (NOx) in the gas emitted from the engine 12. The LNT removes nitrogen oxides (NOx) to clean the gas emitted from the engine 12 and traps particulate matter.

The A/F sensor 28 is disposed between the exhaust port 22 and the catalyst 26 on the exhaust passage. In other words, the A/F sensor 28 is disposed upstream of the catalyst 26 on the exhaust passage through which the gas flows. The A/F sensor 28 measures the air-fuel ratio of the gas discharged from the exhaust port 22. The air-fuel ratio is the ratio of air to fuel.

The $O_2$ sensor 30 is disposed on the exhaust passage and is opposite the exhaust port 22 with the catalyst 26 therebetween. In other words, the $O_2$ sensor 30 is disposed downstream of the catalyst 26 on the exhaust passage through which the gas flows. The $O_2$ sensor 30 measures the oxygen concentration in the gas exiting the catalyst 26. In an embodiment, the $O_2$ sensor 30 serves as an "oxygen concentration detector" configured to measure the oxygen concentration in the catalyst 26.

The air-fuel ratios in the neighborhood of the theoretical air-fuel ratio, that is, a predetermined range from the theoretical air-fuel ratio may be hereinafter referred to as a neutral air-fuel ratio. When the air-fuel ratio of an air-fuel mixture or a gas is lower than the neutral air-fuel ratio, the atmosphere of the air-fuel mixture or the gas may be hereinafter referred to as a rich atmosphere. With the theoretical air-fuel ratio as a reference, the rich atmosphere is too rich in fuel; that is, air accounts for a small proportion of the rich atmosphere. When the air-fuel ratio of an air-fuel mixture or a gas is higher than the neutral air-fuel ratio, the atmosphere of the air-fuel mixture or the gas may be hereinafter referred to as a lean atmosphere. With the theoretical air-fuel ratio as a reference, the lean atmosphere is too rich in air; that is, fuel accounts for a small proportion of the lean atmosphere.

The atmosphere in which the air-fuel ratio is higher than the neutral air-fuel ratio contains a higher concentration of oxygen than the atmosphere in which the air-fuel ratio is adjusted to the neutral air-fuel ratio. When the air-fuel ratio in the gas in the catalyst 26 is higher than the neutral air-fuel ratio, the gaseous atmosphere in the catalyst 26 is a lean atmosphere; that is, the oxygen concentration in the gaseous atmosphere in the catalyst 26 is higher than in the case where the air-fuel ratio in the catalyst 26 is adjusted to the neutral air-fuel ratio.

The atmosphere in which the air-fuel ratio is lower than the neutral air-fuel ratio contains a lower concentration of oxygen than the atmosphere in which the air-fuel ratio is adjusted to the neutral air-fuel ratio. When the air-fuel ratio in the gas in the catalyst 26 is lower than the neutral air-fuel ratio, the gaseous atmosphere in the catalyst 26 is a rich atmosphere; that is, the oxygen concentration in the gaseous atmosphere in catalyst 26 is lower than in the case where the air-fuel ratio in the catalyst 26 is adjusted to the neutral air-fuel ratio.

The $O_2$ sensor 30 applies voltage in accordance with the oxygen concentration in the gas in the catalyst 26. The voltage applied by the $O_2$ sensor 30 may be hereinafter also referred to as $O_2$ sensor voltage. When the gaseous atmosphere in the catalyst 26 is a lean atmosphere, that is, when the gaseous atmosphere in the catalyst 26 contains a higher concentration of oxygen than the atmosphere in which the air-fuel ratio is adjusted to the neutral air-fuel ratio, the $O_2$ sensor voltage corresponding to the lean atmosphere is lower than the $O_2$ sensor voltage corresponding to the atmosphere in which the air-fuel ratio is adjusted to the neutral air-fuel ratio. When the gaseous atmosphere in the catalyst 26 is a rich atmosphere, that is, when the gaseous atmosphere in the catalyst 26 contains a lower concentration of oxygen than the atmosphere in which the air-fuel ratio is adjusted to the neutral air-fuel ratio, the $O_2$ sensor voltage corresponding to the rich atmosphere is higher than the $O_2$ sensor voltage corresponding to the atmosphere in which the air-fuel ratio is adjusted to the neutral air-fuel ratio. Thus, the $O_2$ sensor voltage may be monitored to keep track of the oxygen concentration in the catalyst 26.

The accelerator pedal sensor 32 measures the operation amount of an accelerator pedal.

The vehicle control device 34 includes at least one processor and at least one memory coupled to the at least one processor. The processor and the memory are denoted by 40 and 42, respectively. The processor 40 includes ROM and RAM. Programs and the like are stored in the ROM. The RAM is a work area. The processor 40 operates in cooperation with the programs in the memory 42 to serve as a vehicle controller 50, which exercises an overall control of the vehicle 1.

The vehicle controller 50 controls the fuel injection quantity in accordance with the readings taken by the A/F sensor 28. The vehicle controller 50 determines the operation amount of the accelerator pedal on the basis of the readings taken by the accelerator pedal sensor 32. The vehicle controller 50 then performs calculations by using the operation amount of the accelerator pedal and the speed of the vehicle 1 to determine the driving force demanded by the driver. The vehicle controller 50 controls the motor 10 and the engine 12 in accordance with the demanded driving force.

When the demanded driving force is less than a predetermined value, the vehicle controller 50 performs control to stop the engine 12, in which case the vehicle 1 is powered by the motor 10 while driving. For example, the vehicle controller 50 controls the frequency of the inverter in accordance with the demanded driving force such that the motor 10 is driven at the revolutions per minute (RPM) corresponding to the demanded driving force. The predetermined value may be any value less than or equal to the upper limit of the driving force that can be generated by the motor 10.

When the demanded driving force is more than or equal to the predetermined value, the vehicle controller 50 causes not simply the motor 10 but also the engine 12 to run to satisfy the driver's demand for driving force, in which case the vehicle 1 is powered by both the motor 10 and the engine 12 while driving. For example, the vehicle controller 50 determines, on the basis of the demanded driving force, the ratio of the driving force to be provided by the motor 10 to the driving force to be provided by the engine 12. The vehicle controller 50 causes the motor 10 to rotate at the RPM corresponding to the driving force assigned to the motor 10. Likewise, the vehicle controller 50 causes the engine 12 to run at the RPM corresponding to the driving force assigned to the engine 12.

The following describes a situation in which the engine 12 is stopped while the vehicle 1 is driving; that is, the vehicle 1 is powered by the motor 10 while driving. In some cases, the driver in this situation depresses and eases off the accelerator pedal at short intervals. When the driver depresses the accelerator pedal, the demanded driving force may reach or exceed the predetermined value. When the driver eases off the accelerator pedal, the demanded driving force may fall below the predetermined value. The vehicle 1 under certain circumstances goes back and forth between these states at frequent intervals. The engine 12 is started and stopped at frequent intervals accordingly.

Figure 2:
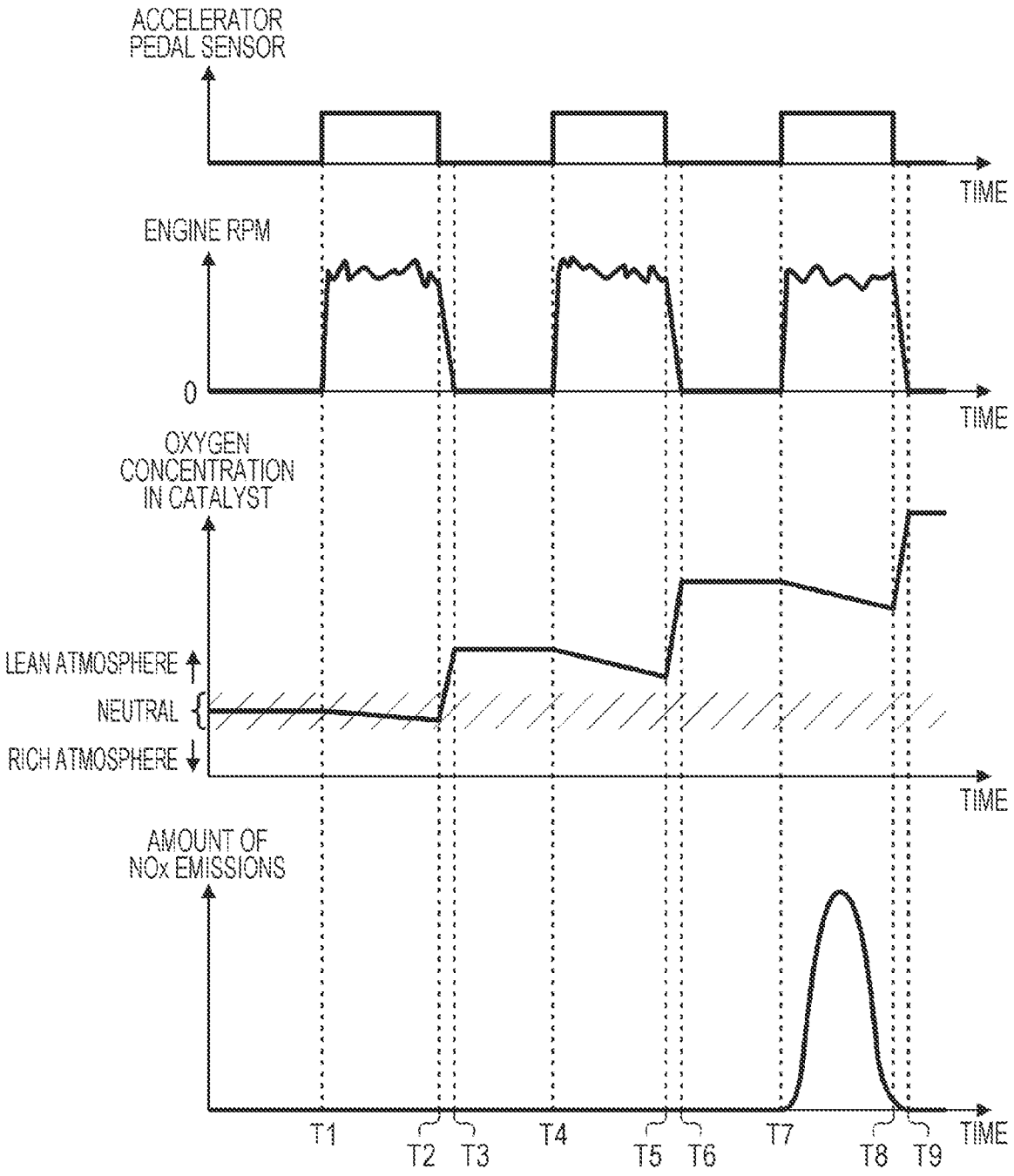
FIG. 2 illustrates problems associated with a state in which an engine is started and stopped at frequent intervals.

FIG. 2 illustrates problems associated with a state in which the engine 12 is started and stopped at frequent intervals. Referring to FIG. 2, a hatched area in the timing chart illustrating the oxygen concentration in the catalyst 26 denotes the oxygen concentration level in a range corresponding to the neutral air-fuel ratio.

At T1 in FIG. 2, the operation amount of the accelerator pedal increases. The measurement value of the operation amount is obtained by the accelerator pedal sensor 32. At the instant when the demanded driving force reaches or exceeds the predetermined value, the engine 12 is started, and the engine RPM increases.

At T2 (upon the lapse of a certain period of time from T1), the operation amount of the accelerator pedal decreases, and the demanded driving force falls below the predetermined value. The vehicle controller 50 takes, at T2, the following actions to stop the engine 12.

At T2, the vehicle controller 50 stops the injection of fuel into the cylinder and, by extension, the burning of the air-fuel mixture in order to stop the engine 12. The piston does not stop moving immediately after the injection of fuel is stopped; that is, the piston keeps sliding up and down while an inertial force acts on the piston. Then, the sliding motion of the piston gradually decreases. At T3 (upon the lapse of a certain period of time from T2), the piston stops moving. In this state, the engine 12 is stopped completely.

During the time period from T2 to T3, that is, during the time from when the injection of fuel is stopped to when the engine 12 is stopped completely, air intake and gas discharge are carried out respectively through the intake port 20 and the exhaust port 22 in conjunction with the sliding motion of the piston. The burning of the air-fuel mixture is stopped over this period of time. Thus, oxygen in the air taken in through the intake port 20 does not undergo combustion and is discharged through the exhaust port 22.

After being discharged without undergoing combustion, oxygen flows through the exhaust passage to the catalyst 26. The oxygen concentration in the catalyst 26 is higher at T3, that is, at the point in time when the engine 12 is stopped than at T2 or any other point in time prior to the time when the engine 12 is stopped. For example, the oxygen concentration in the catalyst 26 at T3, that is, at the point in time when the engine 12 is stopped is higher than the level corresponding to the neutral air-fuel ratio.

With this phenomenon taken into consideration, the vehicle controller 50 controls the engine 12 in such a manner that the air-fuel ratio in the engine 12 during the time period from T1 to T2 (i.e., in the time period over which the engine 12 is running) is somewhat closer than the theoretical air-fuel ratio to the air-fuel ratio in the rich atmosphere without falling outside the range of the neutral air-fuel ratio. Then, the gas in the engine 12 is discharged and flows to the catalyst 26, causing the oxygen concentration in the catalyst 26 to fall somewhat below the oxygen concentration level corresponding to the theoretical air-fuel ratio without falling outside the range of the neutral air-fuel ratio while the engine 12 is running. Consequently, the oxygen concentration in the catalyst 26 increases to a lesser extent when the engine 12 is stopped. Nevertheless, the oxygen concentration in the catalyst 26 can exceed the upper limit of the oxygen concentration level corresponding to the neutral air-fuel ratio when the engine 12 is stopped (see FIG. 2).

Referring to FIG. 2, the engine 12 is restarted at T4 (upon the lapse of a certain period of time from T3). The oxygen concentration in the catalyst 26 at T4 is nearly equal to the oxygen concentration in the catalyst 26 at T3 and is higher than the level corresponding to the neutral air-fuel ratio. While the engine 12 is running after being restarted at T4, the oxygen concentration in the catalyst 26 can be higher than the level corresponding to the neutral air-fuel ratio. The vehicle controller 50 controls the engine 12 in such a manner that the air-fuel ratio in the engine 12 falls somewhat below the neutral air-fuel ratio. As a result, the amount of oxygen flowing from the engine 12 to the catalyst 26 is smaller than in the case where the air-fuel ratio in the engine 12 is set to the neutral air-fuel ratio. From T4 onward, the oxygen concentration in the catalyst 26 decreases gradually.

Referring to FIG. 2, the operation amount of the accelerator pedal decreases at T5, and the demanded driving force falls below the predetermined value at T5 before the oxygen concentration in the catalyst 26 decreases to a sufficient degree. At T5, the vehicle controller 50 takes actions to stop the engine 12. The engine 12 will not be stopped completely until T6. After being discharged without undergoing combustion during the time period from T5 to T6, oxygen flows through the exhaust passage to the catalyst 26. Thus, the oxygen concentration in the catalyst 26 is higher at T6 than at T3.

Referring to FIG. 2, the engine 12 is restarted at T7 (upon the lapse of a certain period of time from T6). The oxygen concentration in the catalyst 26 at T7 is nearly equal to the oxygen concentration in the catalyst 26 at T6. From T7 onward, the oxygen concentration in the catalyst 26 decreases gradually.

The situation at T8 is similar to the situation at T5; that is, the operation amount of the accelerator pedal decreases at T8, and the demanded driving force falls below the predetermined value at T8 before the oxygen concentration in the catalyst 26 decreases to a sufficient degree. Then, the vehicle controller 50 takes actions to stop the engine 12. The engine 12 will not be stopped completely until T9. After being discharged without undergoing combustion during the time period from T8 to T9, oxygen flows through the exhaust passage to the catalyst 26. Thus, the oxygen concentration in the catalyst 26 is higher at T9 than at T6.

As can be understood from the above description, the oxygen concentration in the catalyst 26 does not fall to or below the level corresponding to the neutral air-fuel ratio when the engine 12 is started and stopped at frequent intervals. In some cases, the frequent starting and stopping of the engine 12 cause a further increase in the oxygen concentration in the catalyst 26.

When the oxygen concentration in the catalyst 26 exceeds the level at which the catalyst 26 can remove NOx, the catalyst 26 is unable to remove NOx adequately from the gas discharged from the engine 12. Referring to FIG. 2, the engine 12 is started at T7 and is stopped completely at T9, and the oxygen concentration in the catalyst 26 during the time period from T7 to T9 is higher than the level at which NOx can be removed. Thus, the catalyst 26 in the example illustrated in FIG. 2 is unable to remove NOx adequately during the time period from T7 to T9. As a result, the amount of NOx emissions is greater in this time period than in the time period from T1 to T3 or the time period from T4 to T6.

Figure 3:
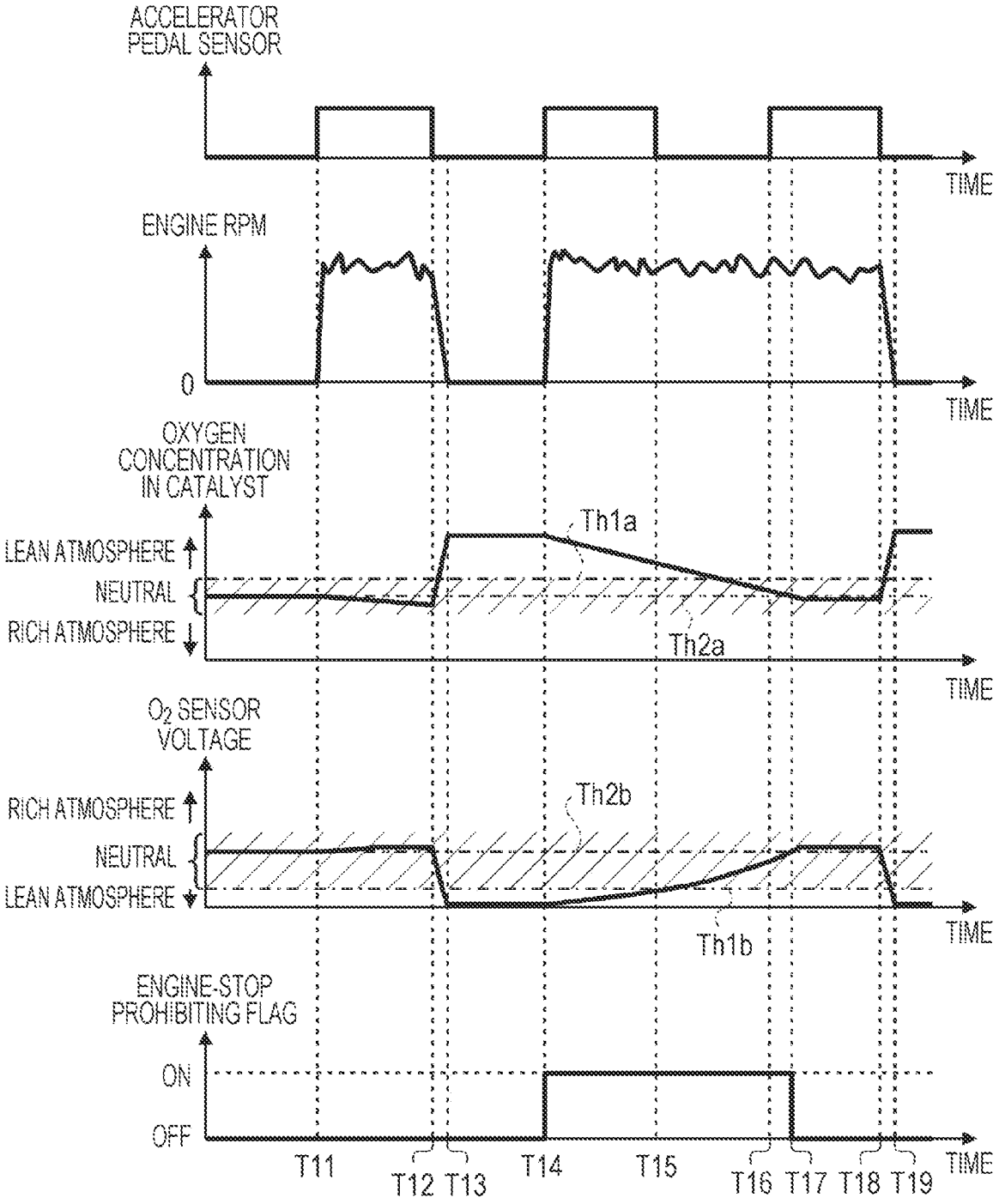
FIG. 3 illustrates how a vehicle controller in an embodiment operates.

In light of the circumstances, the following describes, with reference to FIG. 3, how the vehicle controller 50 of the vehicle 1 according to the present embodiment operates.

FIG. 3 illustrates how the vehicle controller 50 in the present embodiment operates. A hatched area in the timing chart (see FIG. 3) illustrating the oxygen concentration in the catalyst 26 denotes the oxygen concentration level in a range corresponding to the neutral air-fuel ratio. Likewise, a hatched area in the timing chart (see FIG. 3) illustrating the $O_2$ sensor voltage denotes the $O_2$ sensor voltage level in a range corresponding to the neutral air-fuel ratio.

Referring to FIG. 3, the operation amount of the accelerator pedal increases at T11. The measurement value of the operation amount is obtained by the accelerator pedal sensor 32. At the instant when the demanded driving force reaches or exceeds the predetermined value, the engine 12 is started, and the engine RPM increases.

At T12 (upon the lapse of a certain period of time from T11), the operation amount of the accelerator pedal decreases, and the demanded driving force falls below the predetermined value. The vehicle controller 50 takes, at T12, the following actions to stop the engine 12.

At T11, that is, at the point in time when the engine 12 is started, the $O_2$ sensor voltage is in the range corresponding to the neutral air-fuel ratio. In other words, the oxygen concentration in the catalyst 26 is at the level corresponding to the neutral air-fuel ratio. In this case, the vehicle controller 50 controls the engine 12 in such a manner that the oxygen concentration in the catalyst 26 is kept at the level corresponding to the neutral air-fuel ratio. Thus, the oxygen concentration in the catalyst 26 in the time period from T11 to T12 (i.e., a time period over which the engine 12 is running) is kept at the level corresponding to the neutral air-fuel ratio. When the engine 12 is started, the oxygen concentration in the catalyst 26 is at the level corresponding to the neutral air-fuel ratio. In this case, the vehicle controller 50 may control the engine 12 in such a manner that the air-fuel ratio in the engine 12 is somewhat closer than the theoretical air-fuel ratio to the air-fuel ratio in the rich atmosphere without falling outside the range of the neutral air-fuel ratio. When the engine 12 is controlled in this manner, the oxygen concentration in the catalyst 26 in the time period over which the engine 12 is running is kept at the level corresponding to the neutral air-fuel ratio.

The engine 12 will not be stopped completely until T13. After being discharged without undergoing combustion during the time period from T12 to T13, oxygen flows through the exhaust passage to the catalyst 26. Thus, the oxygen concentration in the catalyst 26 increases during the time period from T12 to T13. For example, the oxygen concentration in the catalyst 26 at T13 is above the boundary between the oxygen concentration level in the range corresponding to the neutral air-fuel ratio and the oxygen concentration level in the lean atmosphere. The value at the boundary of the range of the oxygen concentration in the lean atmosphere is the maximum oxygen concentration in the range corresponding to the neutral air-fuel ratio.

During the time period from T12 to T13, the $O_2$ sensor voltage decreases as the oxygen concentration in the catalyst 26 changes. For example, the $O_2$ sensor voltage at T13 is below the boundary between the $O_2$ sensor voltage level in the range corresponding to the neutral air-fuel ratio and the $O_2$ sensor voltage level in the lean atmosphere. The value at the boundary of the range of the $O_2$ sensor voltage in the lean atmosphere is the minimum $O_2$ sensor voltage in the range corresponding to the neutral air-fuel ratio.

Referring to FIG. 3, the engine 12 is restarted at T14 (upon the lapse of a certain period of time from T13). The oxygen concentration in the catalyst 26 at T14 is nearly equal to the oxygen concentration in the catalyst 26 at T13. The $O_2$ sensor voltage at T14 is nearly equal to the $O_2$ sensor voltage at T13.

The vehicle controller 50 in the present embodiment obtains a measurement value of the oxygen concentration in the catalyst 26 at T14 (i.e., at the point in time when the engine 12 is started). The vehicle controller 50 then determines whether the measurement value of the oxygen concentration in the catalyst 26 at the point in time when the engine 12 is started is higher than a predetermined first threshold value Th1*a*.

The predetermined first threshold value Th1*a* is denoted by a dash-dot line in the timing chart (see FIG. 3) illustrating the oxygen concentration in the catalyst 26. The predetermined first threshold value Th1*a* is at the boundary between the oxygen concentration level in the range corresponding to the neutral air-fuel ratio and the oxygen concentration level in the lean atmosphere. In some embodiments, the first threshold value Th1*a* is lower than or equal to the maximum oxygen concentration at which NOx can be removed by the catalyst 26.

A dash-dot line in the timing chart (see FIG. 3) illustrating the $O_2$ sensor voltage denotes a predetermined threshold value Th1*b* of the $O_2$ sensor voltage. The threshold value Th1*b* of the $O_2$ sensor voltage corresponds to the first threshold value Th1*a* of the oxygen concentration in the catalyst 26. For example, the threshold value Th1*b* is at the boundary between the $O_2$ sensor voltage level in the range corresponding to the neutral air-fuel ratio and the $O_2$ sensor voltage level in the lean atmosphere. Th1*b* of the $O_2$ sensor voltage may be any other threshold value corresponding to the first threshold value Th1*a* of the oxygen concentration in the catalyst 26.

The vehicle controller 50 in the present embodiment sets an engine-stop prohibiting flag when the engine 12 is started in a state in which the oxygen concentration in the catalyst 26 is higher than the first threshold value Th1*a*. The engine-stop prohibiting flag indicates whether the engine 12 is prohibited from being stopped. When the engine-stop prohibiting flag is set, the vehicle controller 50 prohibits the engine 12 from being stopped, irrespective of whether a predetermined condition for stopping the engine 12 is satisfied. The engine 12 thus keeps running.

When the engine 12 is started, the vehicle controller 50 obtains a measurement value of the $O_2$ sensor voltage from the $O_2$ sensor 30 and uses the obtained value as a measure of the oxygen concentration in the catalyst 26. When the $O_2$ sensor voltage measurement obtained from the $O_2$ sensor 30 is lower than the threshold value Th1*b*, the vehicle controller 50 sets the engine-stop prohibiting flag. The threshold value Th1*b* corresponds to the first threshold value Th1*a*. The oxygen concentration increases as the $O_2$ sensor voltage decreases. The satisfaction of the condition mentioned above (i.e., the situation in which the $O_2$ sensor voltage is lower than the threshold value Th1*b*) can thus be considered synonymous with the satisfaction of the following condition: the oxygen concentration in the catalyst 26 is higher than the first threshold value Th1*a*.

Referring to FIG. 3, the engine 12 is started at T14, in which case the vehicle controller 50 obtains, at T14, a measurement value of the $O_2$ sensor voltage. The $O_2$ sensor voltage measurement obtained at T14 is lower than the threshold value Th1*b*. In this case, the vehicle controller 50 sets the engine-stop prohibiting flag at T14. The engine-stop prohibiting flag remains set until it is cleared.

While the engine 12 is running after being started at T14, the vehicle controller 50 controls the engine 12 in such a manner that the air-fuel ratio in the engine 12 falls somewhat below the neutral air-fuel ratio. Thus, the oxygen concentration in the catalyst 26 decreases after T14.

From T14 onward, the $O_2$ sensor voltage increases as the oxygen concentration in the catalyst 26 changes.

Referring to FIG. 3, the operation amount of the accelerator pedal decreases, and the demanded driving force falls below the predetermined value at T15 (upon the lapse of a certain period of time from T14). With the engine-stop prohibiting flag being set, the vehicle controller 50 prohibits the engine 12 from being stopped in a state in which the demanded driving force is below the predetermined value. The engine 12 thus keeps running.

While the engine 12 is running, the engine 12 is controlled in such a manner that the air-fuel ratio in the engine 12 falls somewhat below the neutral air-fuel ratio. Thus, the oxygen concentration in the catalyst 26 continues to decrease while the engine 12 keeps running. As the engine 12 keeps running, the oxygen concentration in the catalyst 26 reaches the level corresponding to the neutral air-fuel ratio.

The $O_2$ sensor voltage continues to increase as the oxygen concentration in the catalyst 26 changes while the engine 12 keeps running. As the engine 12 keeps running, the $O_2$ sensor voltage reaches the level corresponding to the neutral air-fuel ratio.

The vehicle controller 50 in the present embodiment does not stop successive readings of the oxygen concentration in the catalyst 26 while the engine 12 is prohibited from being stopped. The vehicle controller 50 determines whether the measurement value of the oxygen concentration in the catalyst 26 is lower than or equal to a predetermined second threshold value Th2*a*.

The predetermined second threshold value Th2*a* is denoted by a dash-dot-dot line in the timing chart (see FIG. 3) illustrating the oxygen concentration in the catalyst 26. The predetermined second threshold value Th2*a* corresponds to the target value of the air-fuel ratio within the range of the neutral air-fuel ratio. The target air-fuel ratio is the theoretical air-fuel ratio. In some embodiments, the target air-fuel ratio is any other value within the range of the neutral air-fuel ratio. For example, the second threshold value Th2*a* is lower than the first threshold value Th1*a*. The second threshold value Th2*a* is not equal to the first threshold value Th1*a*. In some embodiments, however, the second threshold value Th2*a* is equal to the first threshold value Th1*a*.

A dash-dot-dot line in the timing chart (see FIG. 3) illustrating the $O_2$ sensor voltage denotes a predetermined threshold value Th2*b* of the $O_2$ sensor voltage. The threshold value Th2*b* of the $O_2$ sensor voltage corresponds to the second threshold value Th2*a* of the oxygen concentration in the catalyst 26. The threshold value Th2*b* of the $O_2$ sensor voltage corresponds to the target air-fuel ratio within the range of the neutral air-fuel ratio. Th2*b* of the $O_2$ sensor voltage may be any other threshold value corresponding to the second threshold value Th2*a* of the oxygen concentration in the catalyst 26. For example, the threshold value Th2*b* is greater than the threshold value Th1*b*. The threshold value Th2*b* is not equal to the threshold value Th1*b*. In some embodiments, however, the threshold value Th2*b* is equal to the threshold value Th1*b*.

The vehicle controller 50 in the present embodiment invalidates the prohibition of stoppage of the engine 12 upon satisfaction of the following condition: the oxygen concentration in the catalyst 26 is lower than or equal to the predetermined second threshold value Th2*a* in a state in which the engine 12 is prohibited from being stopped, that is, in a state in which the engine-stop prohibiting flag is set.

In the state in which the engine-stop prohibiting flag is set, the vehicle controller 50 does not stop successive readings of the $O_2$ sensor voltage from the $O_2$ sensor 30. The vehicle controller 50 uses the obtained value of the $O_2$ sensor voltage as a measure of the oxygen concentration in the catalyst 26. When the $O_2$ sensor voltage measurement obtained from the $O_2$ sensor 30 is higher than or equal to the threshold value Th2*b*, the vehicle controller 50 clears the engine-stop prohibiting flag. The threshold value Th2*b* corresponds to the second threshold value Th2*a*. The oxygen concentration decreases as the $O_2$ sensor voltage increases. The satisfaction of the condition mentioned above (i.e., the situation in which the $O_2$ sensor voltage is higher than or equal to the threshold value Th2*b*) can thus be considered synonymous with the satisfaction of the following condition: the oxygen concentration in the catalyst 26 is lower than or equal to the second threshold value Th2*a*.

Referring to FIG. 3, the operation amount of the accelerator pedal increases, and the demanded driving force reaches or exceeds the predetermined value at T16 (upon the lapse of a certain period of time from T15). The $O_2$ sensor voltage (see FIG. 3) reaches or exceeds the threshold value Th2*b* at T17 (upon the lapse of a certain period of time from T16). When the $O_2$ sensor voltage is higher than or equal to the threshold value Th2*b*, the oxygen concentration in the catalyst 26 is within the range corresponding to the neutral air-fuel ratio. That is, the atmosphere in the catalyst 26 is completely neutralized.

At T17, that is, when the $O_2$ sensor voltage reaches or exceeds the threshold value Th2*b*, the vehicle controller 50 clears the engine-stop prohibiting flag. The atmosphere in the catalyst 26 is completely neutralized at T17. The vehicle controller 50 may control the engine 12 in such a manner that the air-fuel ratio from T17 onward is equal to the target air-fuel ratio within the range of the neutral air-fuel ratio.

At T17, the operation amount of the accelerator pedal is great, that is, the demanded driving force is greater than or equal to the predetermined value. The engine 12 thus keeps running at T17, that is, at the point in time when the engine-stop prohibiting flag is cleared (see FIG. 3).

At T18 (upon the lapse of a certain period of time from T17), the operation amount of the accelerator pedal decreases, and the demanded driving force falls below the predetermined value. In light of the fact that the engine-stop prohibiting flag is cleared, the vehicle controller 50 takes actions to stop the engine 12. Then, the engine 12 is stopped completely at T19 (upon the lapse of a certain period of time from T18).

If the demanded driving force is less than the predetermined value at the point in time when the engine-stop prohibiting flag is cleared, the vehicle controller 50 may stop the engine 12 at the point in time when the engine-stop prohibiting flag is cleared.

As described above, the vehicle controller 50 in the present embodiment determines whether to prohibit the engine 12 from being stopped. The determination is made on the basis of the condition of the engine 12 and the oxygen concentration measured by the oxygen concentration detector. The condition of the engine 12 herein refers to the operation state of the engine 12 (e.g., the state in which the engine 12 is running or the state in which the engine 12 is stopped). In the case where the accelerator pedal is depressed and eased off at short intervals, the vehicle controller 50 prohibits the engine 12 from being stopped and causes the engine 12 to keep running, and the increase in the oxygen concentration in the catalyst 26 is inhibited accordingly. This enables adequate functioning of the catalyst 26 such that NOx emissions are reduced in a suitable manner.

Figure 4:
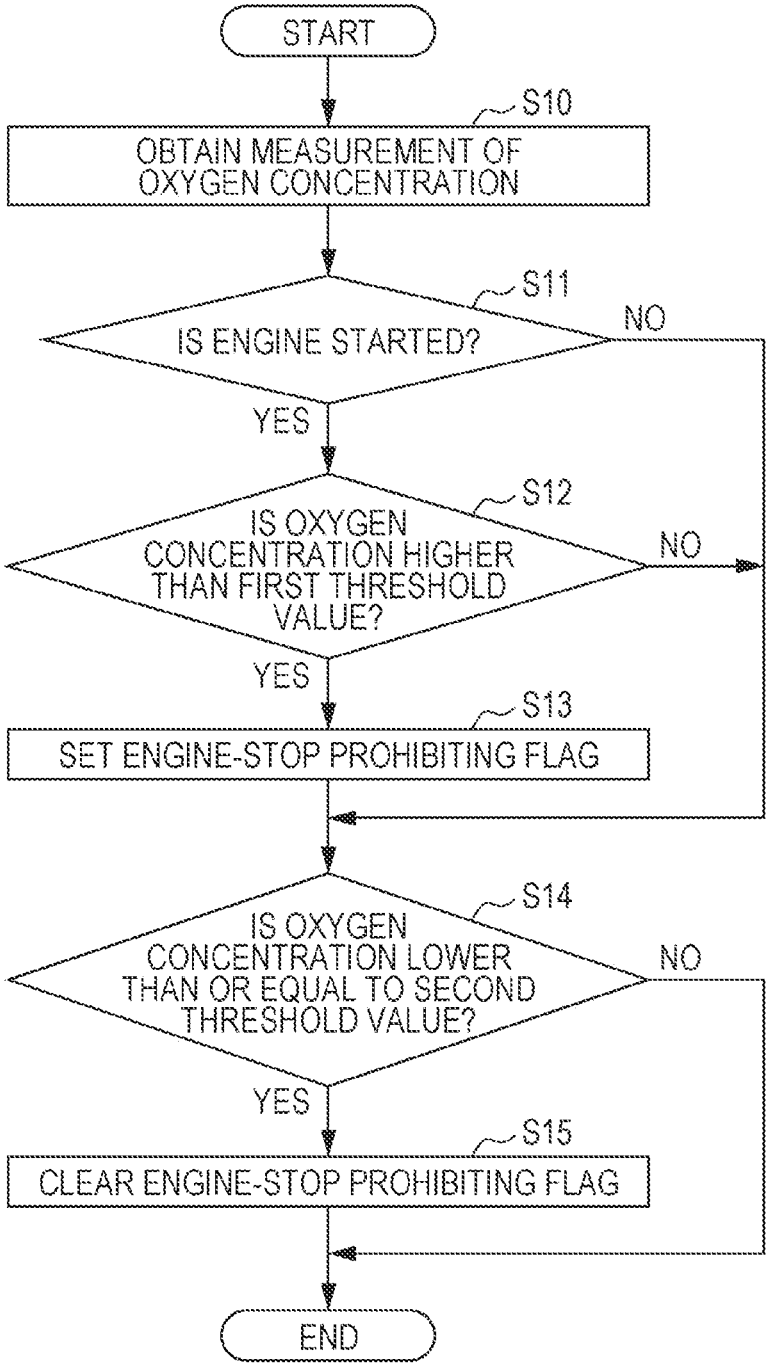
FIG. 4 is a flowchart for describing how the vehicle controller in the embodiment operates.

FIG. 4 is a flowchart for describing how the vehicle controller 50 in the present embodiment operates. The vehicle controller 50 executes the procedure in FIG. 4 periodically (upon the lapse of a predetermined interrupt period).

Upon the lapse of a predetermined interrupt period, the vehicle controller 50 obtains a measurement value of the oxygen concentration in the catalyst 26 (Step S10). For example, the vehicle controller 50 obtains a measurement value of the $O_2$ sensor voltage from the $O_2$ sensor 30 and uses the obtained value as a measure of the oxygen concentration in the catalyst 26.

The vehicle controller 50 then determines whether the engine 12 is started (Step S11). If the engine 12 was not running at the previous interrupt and is running at the current interrupt, the vehicle controller 50 determines that the engine 12 is started.

If the engine 12 is not started (NO in Step S11), the vehicle controller 50 goes to Step S14. A state in which the engine 12 is stopped and a state in which the engine 12 keeps running are herein both regarded as the state in which the engine 12 is not started. In a case where the engine 12 is not running at the current interrupt, it may be determined that the engine 12 is stopped; that is, the engine 12 is not started. In a case where the engine 12 was running at the previous interrupt and is running at the current interrupt, it may be determined that the engine 12 keeps running; that is, the engine 12 is not started.

If the engine 12 is started (YES in Step S11), the vehicle controller 50 determines that the obtained measurement value of the oxygen concentration is higher than the predetermined first threshold value Th1*a* (Step S12). For example, the vehicle controller 50 uses the obtained value as a measure of the oxygen concentration when determining whether the $O_2$ sensor voltage is lower than the threshold value Th1*b* corresponding to the first threshold value Th1*a*. When the $O_2$ sensor voltage is lower than the threshold value Th1*b*, the oxygen concentration is higher than the first threshold value Th1*a*.

If the oxygen concentration is higher than the first threshold value Th1*a*, that is, if the $O_2$ sensor voltage is lower than the threshold value Th1*b* (YES in Step S12), the vehicle controller 50 sets the engine-stop prohibiting flag (Step S13) and then goes to Step S14. The engine-stop prohibiting flag remains set until it is cleared. Once started, the engine 12 is not stopped and keeps running, regardless of whether the demanded driving force falls below the predetermined value, in the state in which the engine-stop prohibiting flag is set.

If the oxygen concentration is lower than or equal to the first threshold value Th1*a*, that is, if the $O_2$ sensor voltage is higher than or equal to the threshold value Th1*b* (NO in Step S12), the vehicle controller 50 goes to Step S14. In this case, the engine-stop prohibiting flag is not set, and the engine 12 is therefore not prohibited from being stopped. When the demanded driving force falls below the predetermined driving force after the start of the engine 12, the engine 12 is stopped.

In Step S14, the vehicle controller 50 determines whether the obtained measurement value of the oxygen concentration is lower than or equal to the predetermined second threshold value Th2*a*. For example, the vehicle controller 50 uses the obtained value of the $O_2$ sensor voltage as a measure of the oxygen concentration and determines whether the $O_2$ sensor voltage is higher than or equal to the threshold value Th2*b* corresponding to the second threshold value Th2*a*. When the $O_2$ sensor voltage is higher than or equal to the threshold value Th2*b*, the oxygen concentration is lower than or equal to the second threshold value Th2*a*.

If the oxygen concentration is lower than or equal to the second threshold value Th2*a*, that is, if the $O_2$ sensor voltage is higher than or equal to the threshold value Th2*b* (YES in Step S14), the vehicle controller 50 clears the engine-stop prohibiting flag (Step S15), and the procedure is brought to an end. When the engine-stop prohibiting flag is cleared, and the prohibition of the stoppage of the engine 12 is invalidated.

If the oxygen concentration is higher than the second threshold value Th2*a*, that is, if the $O_2$ sensor voltage is lower than the threshold value Th2*b* (NO in Step S14), the vehicle controller 50 ends the procedure.

If the driving force demanded at the point in time when the engine-stop prohibiting flag is cleared is greater than or equal to the predetermined value, the vehicle controller 50 causes the engine 12 to keep running. The vehicle controller 50 then stops the engine 12 at the point in time when the demanded driving force falls below the predetermined value. If the driving force demanded at the point in time when the engine-stop prohibiting flag is cleared is less than the predetermined value, the vehicle controller 50 stops the engine 12 at the point in time. With the engine 12 stopped, the vehicle 1 can drive while being powered by the motor 10.

As described above in relation to the vehicle 1 according to the present embodiment, a determination whether the engine 12 is to be prohibited from being stopped is made on the basis of the condition of the engine 12 and the oxygen concentration measured by the oxygen concentration detector. In the case where the accelerator pedal of the vehicle 1 according to the present embodiment is depressed and eased off at short intervals, the engine 12 is prohibited from being stopped and thus keeps running until the atmosphere in the catalyst 26 is neutralized. The vehicle 1 according to the present embodiment can thus eliminate or reduce the possibility that the oxygen concentration in the catalyst 26 will exceed the level at which NOx can be removed by the catalyst 26.

In this way, the vehicle 1 according to the present embodiment enables adequate functioning of the catalyst 26.

With the oxygen concentration being measured by the oxygen concentration detector, the engine 12 of the vehicle 1 according to the present embodiment is prohibited from being stopped when the engine 12 is started in a state in which the oxygen concentration in the catalyst 26 is higher than the predetermined first threshold value Th1*a*. Thus, the vehicle 1 according to the present embodiment can more suitably inhibit the increase in the oxygen concentration in the catalyst 26.

With the oxygen concentration being measured by the oxygen concentration detector, the prohibition of stoppage of the engine 12 is invalidated when the oxygen concentration in the catalyst 26 is lower than or equal to the predetermined second threshold value Th2*a* in a state in which the engine 12 of the vehicle 1 according to the present embodiment is prohibited from being stopped. In this way, the vehicle 1 according to the present embodiment prevents the possibility that the engine 12 will keep running uselessly after the atmosphere in the catalyst 26 is neutralized. The reduction in fuel efficiency will be inhibited accordingly.

An embodiment of the disclosure has been described with reference to the accompanying drawings. The disclosure is not limited to the embodiment. It is obvious that variations and modifications can be made by those skilled in the art without departing from the scope hereinafter claimed, and the variations and modifications also fall within the technical scope of the disclosure.

The vehicle control device 34 illustrated in FIG. 1 can be implemented by circuitry including at least one semiconductor integrated circuit such as at least one processor (e.g., a central processing unit (CPU)), at least one application specific integrated circuit (ASIC), and/or at least one field programmable gate array (FPGA). At least one processor can be configured, by reading instructions from at least one machine readable tangible medium, to perform all or a part of functions of the vehicle control device 34. Such a medium may take many forms, including, but not limited to, any type of magnetic medium such as a hard disk, any type of optical medium such as a CD and a DVD, any type of semiconductor memory (i.e., semiconductor circuit) such as a volatile memory and a non-volatile memory. The volatile memory may include a DRAM and a SRAM, and the non-volatile memory may include a ROM and a NVRAM. The ASIC is an integrated circuit (IC) customized to perform, and the FPGA is an integrated circuit designed to be configured after manufacturing in order to perform, all or a part of the functions of the modules illustrated in FIG. 1.

The invention claimed is:

1. A vehicle comprising:

an engine;

a catalyst configured to clean gas emitted from the engine;

an oxygen concentration detector configured to measure oxygen concentration in gas exiting the catalyst; and a control device comprising at least one processor, and at least one memory coupled to the at least one processor, wherein the at least one processor is configured to perform processing comprising, determining a condition of the engine;

prohibiting the engine from being stopped based on a determination that the engine is started and the oxygen concentration is higher than a predetermined first threshold value, and invalidating the prohibiting in a case where the oxygen concentration is lower than or equal to a predetermined second threshold value, wherein the predetermined second threshold value is lower than the predetermined first threshold value.

2. The vehicle according to claim 1, wherein the predetermined first threshold value is within a range between the oxygen concentration corresponding to a neutral air-fuel ratio and the oxygen concentration corresponding to a lean atmosphere.

3. The vehicle according to claim 1, wherein the predetermined second threshold value corresponds to a target air-fuel ratio within a range of a neutral air-fuel ratio.

* * * * *